US011766707B2

(12) United States Patent
Vassena

(10) Patent No.: US 11,766,707 B2
(45) Date of Patent: Sep. 26, 2023

(54) THREADING DIE FOR COLD-DRAWING A METAL WIRE

(71) Applicant: VASSENA FILIERE S.R.L., Malgrate (IT)

(72) Inventor: Davide Vassena, Malgrate (IT)

(73) Assignee: VASSENA FILIERE S.R.L., Malgrate (IT)

( * ) Notice: Subject to any disclaimer, the term of this patent is extended or adjusted under 35 U.S.C. 154(b) by 0 days.

(21) Appl. No.: 17/904,398

(22) PCT Filed: Feb. 18, 2021

(86) PCT No.: PCT/IB2021/051362

§ 371 (c)(1),
(2) Date: Aug. 17, 2022

(87) PCT Pub. No.: WO2021/165862

PCT Pub. Date: Aug. 26, 2021

(65) Prior Publication Data

US 2023/0063440 A1 Mar. 2, 2023

(30) Foreign Application Priority Data

Feb. 20, 2020 (IT) ..... 102020000003464

(51) Int. Cl.
*B21C 3/14* (2006.01)

(52) U.S. Cl.
CPC ..... *B21C 3/14* (2013.01)

(58) Field of Classification Search
CPC .... B21C 3/02; B21C 3/04; B21C 3/12; B21C 3/14; B21C 9/005
See application file for complete search history.

(56) References Cited

U.S. PATENT DOCUMENTS 3,248,972 A * 5/1966 Beghi ..... B21C 25/10 76/107.4
3,605,476 A * 9/1971 Hinshaw ..... B21C 1/00 72/274
4,038,858 A * 8/1977 DeZuba ..... B21C 3/02 72/274
4,270,373 A 6/1981 Hirato et al.
2013/0255344 A1* 10/2013 Rodd ..... B21C 3/04 72/274

FOREIGN PATENT DOCUMENTS

CN 202461157 U 10/2012
DE 20220804 U1 4/2004
EP 1100635 A1 5/2001
EP 1554062 A1 7/2005

* cited by examiner

*Primary Examiner* — Teresa M Ekiert

(74) *Attorney, Agent, or Firm* — Browdy and Neimark, PLLC

(57) ABSTRACT

A threading die (100) for cold-drawing a metal wire (4) is described; the threading die comprises a hole (103) for the inlet of the wire to be drawn and the hole comprises a conical part (106) for drawing the metal wire and a truncated-cone shaped part (105) which precedes the conical part in the advance path of the metal wire and wherein no decrease in the diameter of the metal wire occurs; the base with the greater diameter (111) of the truncated-cone shaped part precedes the base with the shorter diameter (112) in the advance path of the metal wire.

7 Claims, 2 Drawing Sheets

THREADING DIE FOR COLD-DRAWING A METAL WIRE

The present invention relates to a threading die for cold-drawing a metal wire.

Drawing, i.e. the reduction of the section of a wire or of another metal object by means of threading dies, is obtained by pulling the material through the threading die by means of drawing machines.

A technique commonly used, above all for round-section metal wires, allows to obtain a drawing of a metal wire by means of subsequent reductions in section due to the passage of the wire in threading dies placed one after the other and comprised, together with a lubricant containment tank for the wire, in a single drawing apparatus. Lubrication is obtained by interposing the lubricant between the metal wire and the threading die due to both the motion of the wire towards the threading die and to the geometric profile of the threading die itself.

An equipment for cold-drawing a metal wire is described in patent EP 1554062. The equipment comprises a succession of a cylindrical hole bushing and a conical hole die. The bushing is inserted in a support and ends with an extension engaged in said conical hole of the threading die. The support has a first annular protrusion and the threading die has a second annular protrusion coupled with said first protrusion so as to keep the bushing and the die in position.

With said equipment, the mounting of the threading die on the bushing becomes a very simple operation; however, with said piece of equipment it is always necessary to mount the threading die on the bushing to obtain a good drawing effectiveness, since the bushing allows the adhesion of the lubricant on the wire to be drawn.

In the light of the prior art described, it is the object of the present invention to produce a threading die for cold-drawing a metal wire which is different from the known ones.

In accordance with the present invention, such object is achieved by means of a threading die for cold-drawing a metal wire, said threading die comprising a hole for the inlet of the wire to be drawn, said hole comprising a conical part for drawing the metal wire, said hole of the threading die comprising a truncated-cone shaped part which precedes the conical part in the advance path of the metal wire and wherein no decrease in the diameter of the metal wire occurs, the base with a greater diameter of said truncated-cone shaped part preceding the base with a shorter diameter in the advance path of the metal wire, said hole of the threading die comprising an initial part which precedes the truncated-cone shaped part in the advance path of the metal wire, characterized in that said initial part ends in the advance path of the metal wire with a diameter which is shorter than the diameter of the base with a greater diameter of the truncated-cone shaped part, said truncated-cone shaped part being arranged so as to form a containment space for a lubricant among the side wall of the truncated-cone shaped part, the initial part and the metal wire.

The features and the advantages of the present invention will be apparent from the following detailed description of a practical embodiment thereof, illustrated by way of non-limiting example in the accompanying drawings, in which.

Figure 1:
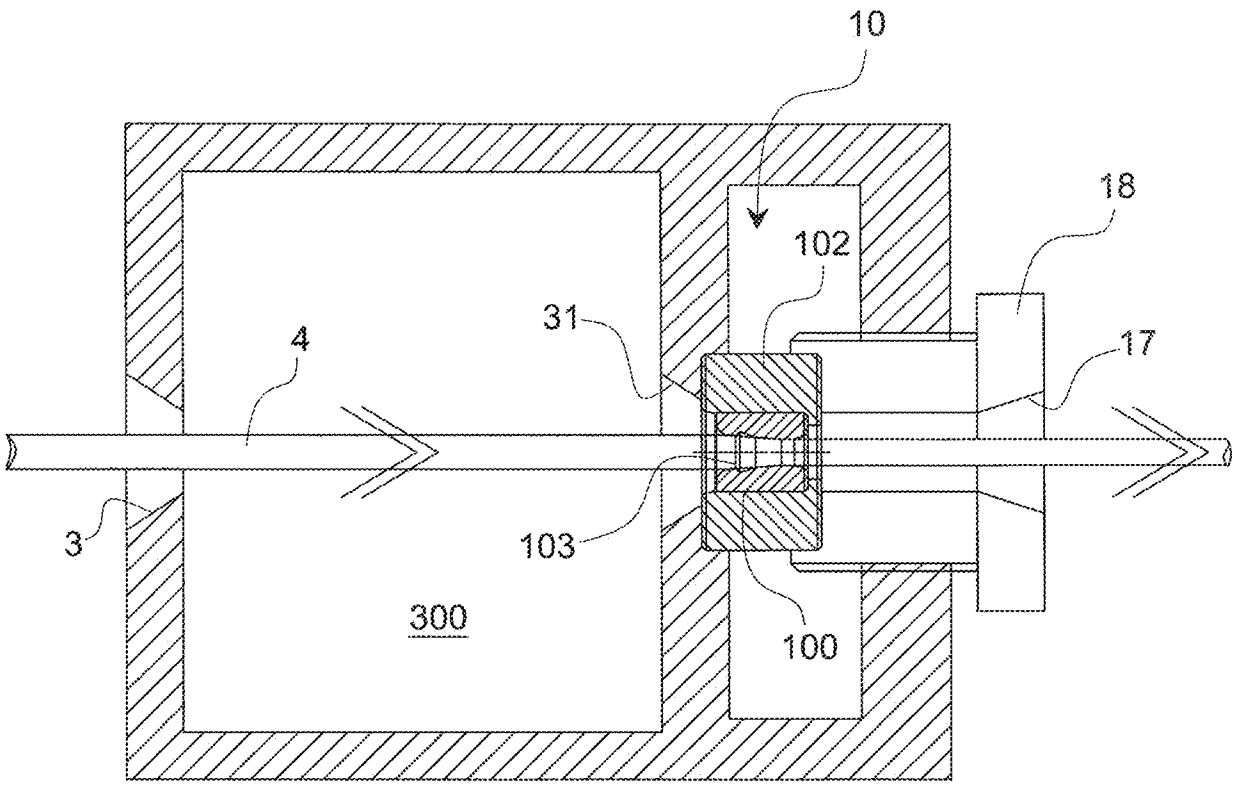
FIG. 1 shows a cross-section of an apparatus for cold-drawing a metal wire comprising the threading die according to the present invention.

With reference to FIG. 1, an apparatus for the cold-drawing of a metal wire is shown. The apparatus comprises an external body 1 provided therein with a tank 2 containing stearates based on calcium or sodium or another lubricating material 300. Said tank 2 has, at a side end, an inlet hole 3 for the passage of a metal wire 4 (steel, copper, aluminum, etc.) which must be drawn. The diameter of the hole 3 is greater with respect to the section of the metal wire 4.

The tank 2 is provided, on the other side end thereof, with a drawing equipment 10, according to the present invention, which is able to draw the metal wire 4; the equipment 10 is held in position on the body 1 by a threaded cap 18 fastened to the external body 1 and crossed by a drain hole 17 for the outlet of the wire 4.

Figure 2:
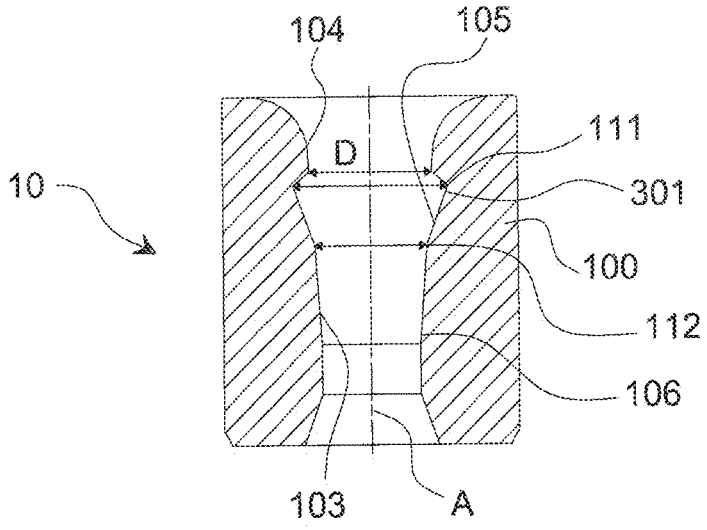
FIG. 2 shows, more in detail, the threading die of FIG. 1.
Figure 3:
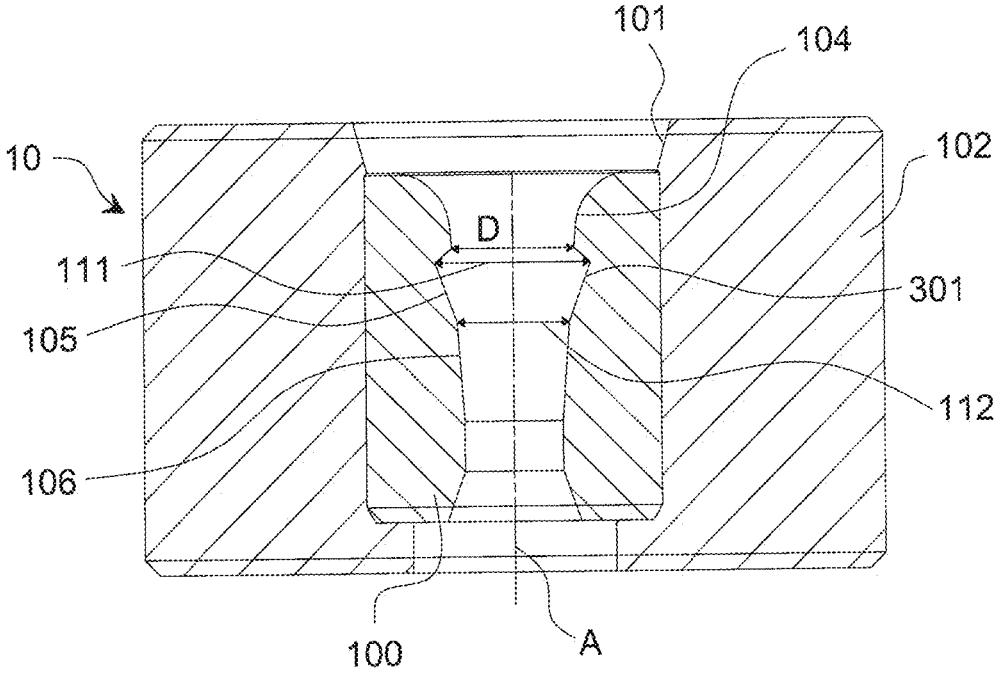
FIG. 3 shows the threading die according to the invention and the support means thereof.

The equipment 10, better shown in FIGS. 2 and 3, comprises, in the advance path of the metal wire 4, a threading die 100 comprising a circular-section body, generally made of tungsten carbide, commonly known as hard metal or widia, provided with a hole 103 which is subject to variations in diameter within the same threading die 100. The hole 103 comprises at least one central part 105 which preferably has a truncated-cone shape with a decreasing diameter, to facilitate the inlet of the metal wire 4, and a final part 106 with a conical shape; the truncated-cone shaped part 105 precedes the conical part in the advance path of the metal wire and inside it no decrease in the diameter of the metal wire occurs. The base with a greater diameter 111 of the truncated-cone shaped part precedes the base with a shorter diameter 112 in the advance path of the metal wire. Preferably the walls of said truncated-cone shaped part of the hole in the threading die forming an angle of less than 30° with the hole axis.

In particular, the hole 103 of the threading die 100 may be divided into an initial part 104, the central part 105 with a truncated-cone shape with a decreasing diameter to facilitate the inlet of the metal wire 4, and the final part 106 with a conical shape. The threading die 100 is supported and comprised in a casing 102, generally made of steel.

The initial part 104 precedes the part 105 in the advance path of the metal wire and has a diameter D in the final part adjacent to the part 105; the diameter D is shorter than the diameter 111 of the base having a diameter greater than the truncated-cone part 105.

The central truncated-cone part 105 acts as a bushing since it allows the passage of the metal wire 4 without performing a drawing, but allowing the adhesion of the lubricant 300 to the metal wire 4. The part 105 comprises, as the inlet hole of the metal wire, the base with a greater diameter 111, which has a diameter greater than the diameter D of the initial part 104.

The hole 103 of the threading die has, after the part 105, the conical shaped part 106 with a decreasing diameter, whose longitudinal axis of symmetry A coincides with the axis of symmetry of the truncated-cone part 105 and of the initial part 104. The part 105 has a more decreasing diameter with respect to the part 106. The conical part 106 is used for drawing the metal wire.

During the drawing operation in the structure described, the metal wire 4, passing through the tank 2, collects the lubricant 300 contained therein. The wire 4 then passes through the initial part 104 and through the central part 105 of the threading die 100 without any reduction in diameter; then, the wire 4 passes through the part 106 of the threading die 100 with a conical hole where the drawing is performed. Together with the wire 4, the lubricant reaches the part 105 where it has the pressure and retains the lubricating properties suitable for the correct lubrication of the wire 4 subjected to drawing.

In the advance path of the metal wire 4, the casing 102 comprises a hole 101, preferably circular, for the inlet of the metal wire which precedes the hole 103 of the threading die in the advance path of the metal wire 4, as better shown in FIG. 2; the hole 101 of the casing 102 is coaxial to the hole 103 of the threading die.

The base with a greater diameter 111 of the hole 103 in the central truncated-cone part 105 has a diameter greater than diameter D of the hole 103 of the initial part 104 of the threading die in the advance path of the metal wire. Thereby, a space 301 is formed for collecting the lubricant 300 among the side wall of the hole 103 of the part with a truncated-cone section 105, the metal wire 4 and the initial part 104. The presence of the space 301 for collecting the lubricant 300 allows a better efficiency of the cold-drawing of the metal wire, even at low drawing speeds.

Preferably, the difference between the diameter of the hole 103 in the initial part 104 and the base with a greater diameter 111 of the central part 105 is preferably between 4 and 6 mm.

Preferably, the walls of the truncated-cone part 105 of the hole 103 form, with the axis A, an angle of less than 30°; in fact, with angles greater than 30° it is not possible to drain the lubricant 300 inside the threading die 100 and the lubricant returns to the tank 2.

The presence of the space 301 made in this way allows to form a more compact lubricant padding, with more pressure in the threading die; for such reason, the molecules of the metal wire 4 are subject to a lower stress during the drawing step since the friction coefficient is lowered from 0.05 to 0.005.

Preferably the walls of the truncated-cone part 105 of the hole 103 form, with axis A, an angle of 20° to optimize the lubrication of the metal wire 4.

Preferably the diameter D of the hole 103 in the part 104 coincides with the diameter of the base with a shorter diameter 112 of the truncated-cone shaped part 105; thereby, the lubrication of the wire 4 is increased.

The presence of the space 301 allows an efficient cold-drawing of the metal wire 4 both at high speeds, conventionally 40 m/s, and at low speeds, conventionally 1 m/s. In fact, the lubrication of the metal wire 4, which is obtained at a drawing speed of 1 m/s, is considerably greater than that which was obtained at the same drawing speed with known equipment. Furthermore, the presence of the space 301 allows to eliminate the vibration effect which occurs in the case of drawing a metal wire 4 with a high carbon content at speeds greater than 20 m/s.

Furthermore, the piece of equipment according to the present invention allows the use of a high-pressure lubricant 300, for example at 200 atm; this improves the metal wire drawing efficiency.

Improving the lubrication of the metal wire 4 lengthens the life, preferably by 80%, of the equipment 10 with respect to known equipment.

Preferably the threading die 100 according to the invention has a smaller size with respect to the known assembly of bushing and threading die; this determines a smaller size of the equipment 10 in the apparatus 1.

Preferably the threading die 100 is made so that the central truncated-cone part 105 has a smaller size with respect to the conical part 106; for example, in a threading die having a length of 35 mm, the conical part 106 for drawing the metal wire 4 has a length of 10 mm while the truncated-cone part 105 has a length of 6 mm.

The invention claimed is:

1. A threading die for cold-drawing a metal wire, said threading die comprising a hole for the inlet of the wire to be drawn, said hole comprising a conical part for drawing the metal wire, said hole of the threading die comprising a truncated-cone shaped part which precedes the conical part in the advance path of the metal wire and wherein no decrease in the diameter of the metal wire occurs, the base with a greater diameter of said truncated-cone shaped part preceding the base with a shorter diameter in the advance path of the metal wire, said hole of the threading die comprising an initial part which precedes the truncated-cone shaped part in the advance path of the metal wire, characterized in that said initial part ends in the advance path of the metal wire with a diameter (D) which is shorter than the diameter of the base with a greater diameter of the truncated-cone shaped part, said truncated-cone shaped part being arranged so as to form a containment space for a lubricant among the side wall of the truncated-cone shaped part, the initial part and the metal wire.

2. A threading die according to claim 1, characterized in that the walls of said truncated-cone shaped part of the hole of the threading die form an angle of less than 30° with the hole axis.

3. A threading die according to claim 2, characterized in that the walls of said truncated-cone shaped part of the hole of the threading die form an angle of 20° with the hole axis (A).

4. A threading die according to claim 1, characterized in that said initial part ends in the advance path of the metal wire with a diameter which coincides with the diameter of the base with the shorter diameter of the truncated-cone shaped part.

5. A threading die according to claim 1, characterized in that the difference between the diameter of the hole with which the initial part ends in the advance path of the metal wire and the base with a greater diameter of the central part is between 4 and 6 mm.

6. Equipment for cold-drawing a metal wire comprising a threading die as defined in claim 1 and means for supporting the threading die.

7. An apparatus for cold-drawing a metal wire, said apparatus comprising a wire lubrication tank and a drawing equipment arranged at the output of said tank, said drawing equipment being defined as in claim 6.

* * * * *